United States Patent [19]

Brandon et al.

[11] Patent Number: 4,994,861

[45] Date of Patent: Feb. 19, 1991

[54] PRINTING MACHINE WITH CHARGE NEUTRALIZING SYSTEM

[75] Inventors: Fred Y. Brandon; James P. Harden; Paul D. Horrall, all of Lexington; Troy A. Lee, Nicholasville; Kermit A. Meece, Lexington, all of Ky.

[73] Assignee: International Business Machines Corporation, Armonk, N.Y.

[21] Appl. No.: 374,519

[22] Filed: Jun. 30, 1989

[51] Int. Cl.[5] ..... G03G 15/16; G03G 21/00; B65H 31/00

[52] U.S. Cl. ..... 355/274; 271/208; 271/303; 355/315; 361/214; 361/221

[58] Field of Search ..... 355/219, 271, 272, 274, 355/276, 315; 361/212, 214, 220, 221; 271/208, 303

[56] References Cited

U.S. PATENT DOCUMENTS

| | | | |
|---|---|---|---|
| 2,023,321 | 12/1935 | Gutman | 361/214 X |
| 3,850,519 | 11/1974 | Weikel, Jr. | 361/214 X |
| 4,130,852 | 12/1978 | Peffer et al. | 361/214 X |
| 4,307,432 | 12/1981 | Nishikawa | 361/214 X |
| 4,352,143 | 9/1982 | Uno | 361/221 |
| 4,363,070 | 12/1982 | Kisler | 361/221 X |
| 4,449,808 | 5/1984 | Abreu | 355/274 |
| 4,494,166 | 1/1985 | Billings et al. | 361/214 |
| 4,579,441 | 4/1986 | Hart et al. | 361/221 X |
| 4,640,606 | 2/1987 | Inamoto | 355/315 |
| 4,688,927 | 8/1987 | Oda et al. | 355/272 |
| 4,739,363 | 4/1988 | Hoshika et al. | 361/214 X |
| 4,741,524 | 5/1988 | Bromage | 271/208 |
| 4,771,360 | 9/1988 | Ayash | 361/221 |

FOREIGN PATENT DOCUMENTS

| | | | |
|---|---|---|---|
| 62-16953 | 1/1987 | Japan | 271/208 |

*Primary Examiner*—Fred L. Braun
*Attorney, Agent, or Firm*—John W. Girvin, Jr.

[57] ABSTRACT

A printing machine includes a charge neutralizing system for neutralizing static charge on sheets of material fed therethrough. The charge neutralizing system includes a grounded wire (47) located in proximity to the sheets for neutralizing charge on the sheets. The charge neutralizing system further includes a grounded conductive brush (81) mounted on a sheet deflector (61) so that one end of the brush (77) contacts sheets as they traverse a first sheet feed path (71) and the other end of the brush (79) contacts sheets are they are routed by the deflector to a second alternative sheet feed path (63). The grounded brush (81) further serves to decelerate the sheet as it exits the printing machine over the second sheet feed path (63).

6 Claims, 2 Drawing Sheets

FIG. 4
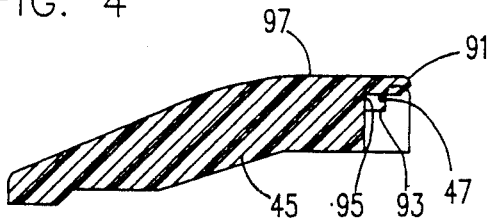
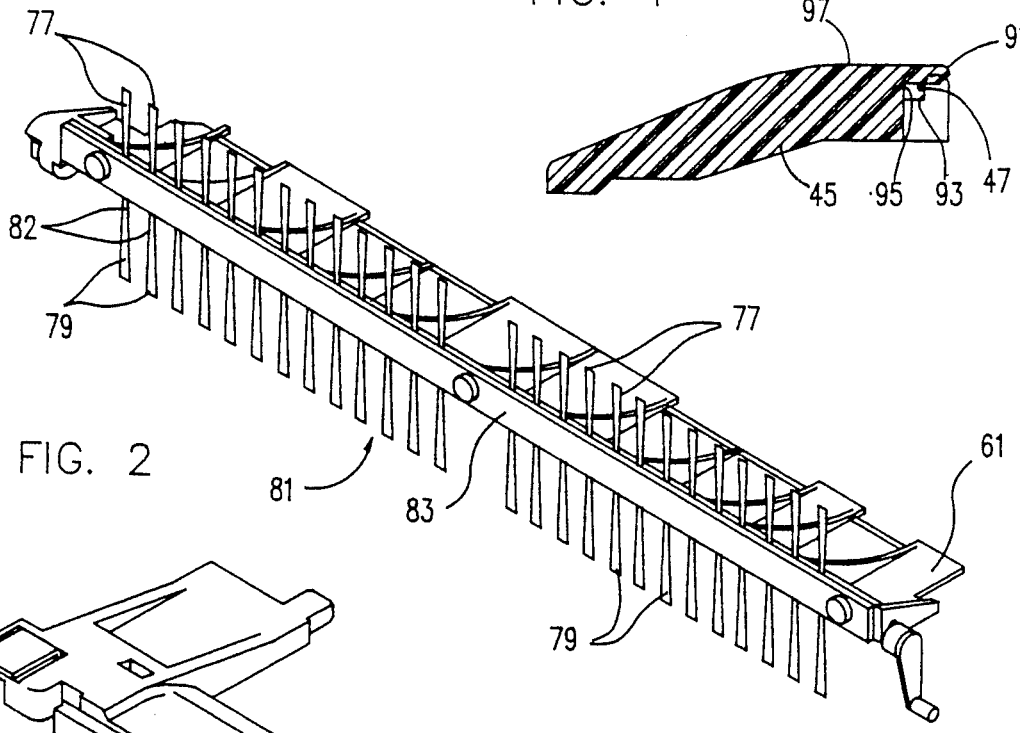
FIG. 2
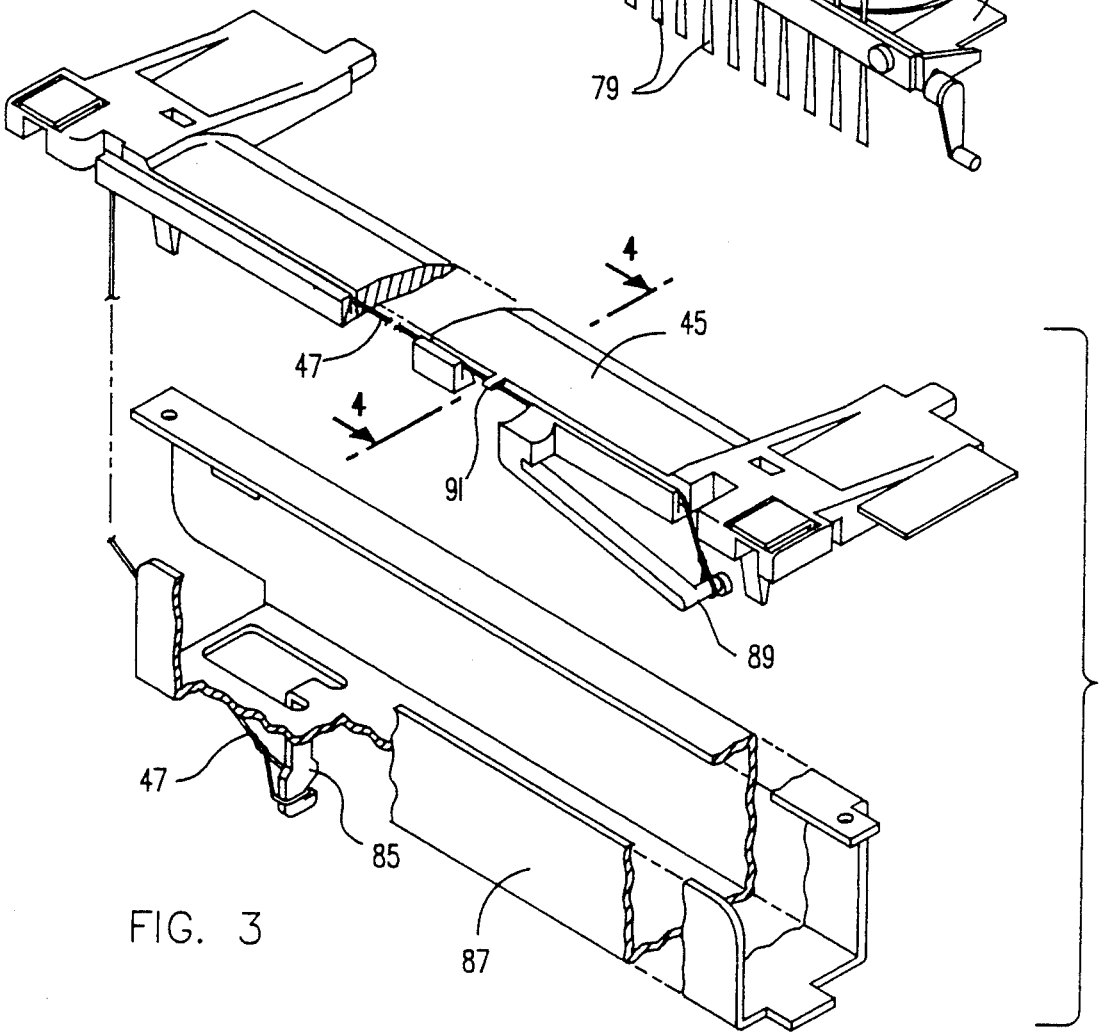
FIG. 3

PRINTING MACHINE WITH CHARGE NEUTRALIZING SYSTEM

BACKGROUND OF THE INVENTION

1. Technical Field

This invention relates to a charge neutralizing system for neutralizing the static charge on sheets fed through a printing machine.

2. Background Art

Printing machines and especially those employing an electrophotographic printing process have employed various means to eliminate the static charge on printed sheets which pass through the machines. The electrophotographic process usually involves passing each sheet to a photoreceptor in the form of a photoconductor drum which bears a toned image which is to be transferred to the sheet. In order to effect the transfer of the toned image from the photoconductor drum to the sheet, a corona discharge device is utilized to charge the non-image receiving surface of the sheet to a polarity opposite that of the toner. The toner is thus attracted to the sheet which is then separated from the photoconductor drum. At this point, the charge on the sheet must be lessened in order to transport the sheet to a fixing station where the toner is heated so as to melt it and thus form or fix a permanent image on the sheet. Prior to fixing, the toned image may be disturbed as the charged sheet containing the toned image passes ground planes or the like as it progresses along the sheet transport. The charge on the sheets has typically been reduced by placing a second corona device in close proximity to the transfer station. This second corona device sprays the sheet with a charge opposite that sprayed at the transfer station. Such corona devices are connected to an AC or DC voltage source. It has further been necessary to utilize control circuits to closely regulate the amount of charge placed by the second corona device. Typical prior art patents disclosing such structure include U.S. Pat. Nos., 4,449,808, 4,640,606 and 4,688,927. Such power supplies and controls add further expense to the printing machine.

In addition to reducing the static charge of sheets at the transfer station and prior to the fixing station, prior electrophotographic printing machines have incorporated various other static elimination devices along the sheet feed path in order to facilitate the movement and stacking of the sheets. Such devices have included grounded brushes which either contact the sheet or which are located in close proximity to the sheet as disclosed in prior U.S. Pat. No. 4,494,166. Further, such prior art printing machines often provide several exit paper paths in order to selectively orient the sheet upon exit from the machine. Each such path requires static elimination for proper operation and stacking of the sheets.

SUMMARY OF THE INVENTION

In order to provide a low cost charge neutralizing system for a printing machine, the present invention employs a grounded wire located in close proximity to the transfer station which lessens the charge on the sheet and further employs a single grounded brush located on a sheet deflector so that the first end of the brush contacts sheets as they pass along a first exit path and so that the second end of the brush contacts sheets as they pass along a second exit path. The single grounded wire may be employed in an electrophotographic printing machine immediately adjacent the transfer station so as to dissipate charge of sheets bearing toned images prior to the toned image being fixed. The sheet deflector is located adjacent a sheet stacking receptacle so as to remove the charge from the sheets that pass thereby and to further provide a drag force on the sheet so as to facilitate its correct stacking.

A preferred feature of the present invention is to provide an inexpensive charge neutralizing system comprising a tensioned wire connected to ground and located closely adjacent to statically charged sheets bearing electrostatic toned images thereon so as to dissipate the charge on the sheet without disturbing the toned images. The wire is precisely positioned with respect to an adjacent paper guide so as to prevent it from discharging the charge on the paper guide. Another preferred feature of the present invention is to provide a single brush located on a sheet deflector so that both ends of the brush are operative to discharge the static charge of sheets passing therepast over differing feed paths.

The foregoing and other features and advantages of this invention will be apparent from the following more particular description of the preferred embodiment of the invention as illustrated in the accompanying drawing.

IN THE DRAWING

FIG. 2 is a perspective view of the sheet deflector and grounded brush of the present invention.

FIG. 3 is an exploded perspective view of the transfer corona housing, paper guide and grounded charge dissipation wire.

FIG. 4 is a side sectional view of the paper guide and grounded charge dissipation wire.

DESCRIPTION

Figure 1:
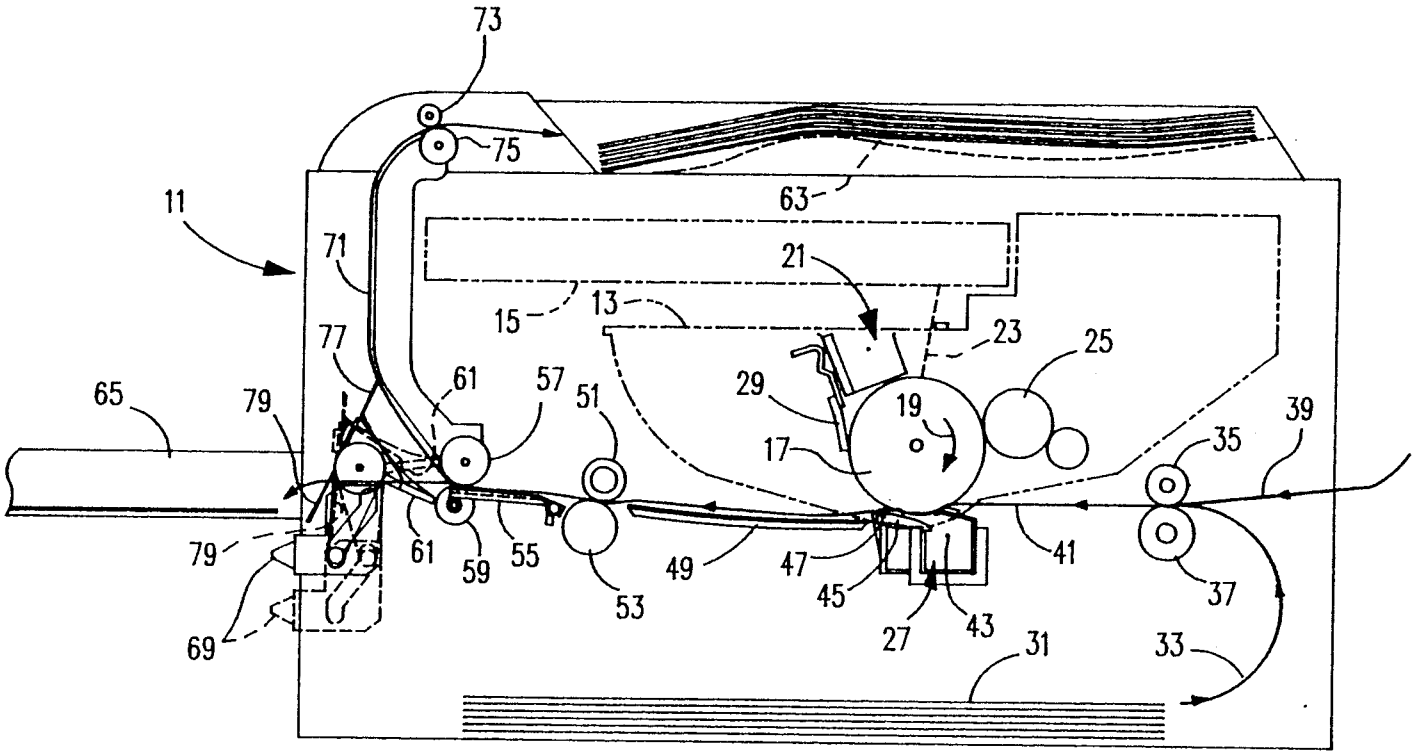
FIG. 1 is a schematic side view of an electrophotographic printing machine incorporating the charge neutralizing system of the present invention.

Referring now to the drawing and more particularly to FIG. 1 thereof, a schematic side view of an electrophotographic printing machine 11 incorporating the charge neutralizing system of the present invention is depicted. The electrophotographic printing machine 11 includes a disposable cartridge 13, a laser imaging device 15 and various sheet transporting apparatus to be described. The disposable cartridge 13 contains a rotatable photoconductor drum 17 which rotates in the direction of arrow 19 past various conventional processing stations to be described. The photoconductor drum 17 is first charged by a charge corona 21 as it rotates therepast to a relatively high and uniform potential. Next, the charged portion of the photoconductor drum 17 rotates past an imaging station whereat laser beam 23 selectively discharges the charge on the photoconductor drum 17 in accordance with an image pattern. The imaged photoconductor drum 17 then rotates past a developer roll 25 containing finely divided charged toner particles thereon. The toner particles are preferentially attracted to the charged areas on the photoconductor drum 17 to form a toned image pattern thereon corresponding to the image pattern established by the laser beam 23. It is this toner image which is to be transferred at the transfer station 27 to sheets of material such as paper or plastic so as to form an image on the sheets. A cleaning station 29 removes residual toner particles from the photoconductor drum 17 that remain thereon following transfer.

The sheets may be introduced from a stack of sheets 31 and fed over a feed path 33 to the feed roll pair 35, 37 or they may be manually introduced by a machine operator over the sheet feed path 39 to the feed roll pair 35, 37. Sheets thusly fed to the feed roll pair 35, 37 are forwarded thereby toward the photoconductor drum 17 over the feed path 41. As the sheet contacts the photoconductor drum 17, it moves therewith past a transfer corona 43 connected to a high potential source (not shown). The transfer corona sprays ions onto the backside of the sheet in order to attract the toner image from the surface of the photoconductor drum 17 to the sheet.

After transfer, the sheet passes over the plastic guide 45 past the grounded wire 47 located therein and thence over the guide 49 to the fuser roll 51 and backup roll 53 pair. The fuser roll 51 is heated so as to melt the toner image electrostatically clinging to the sheet into the surface of the sheet thereby permanently fixing it to the sheet. Thereafter the sheet moves over guide 55 to the roll pair 57, 59.

The sheet is then forwarded in accordance with the setting of deflector 61 to the sheet receptacle 63 or in the alternative to the sheet receptacle 65. When the manual switch 69 is in its upmost solid line position, deflector 61 is located in its solid line position causing sheets to advance from the roll pair 57, 59 over the guide 71 to the roll pair 73, 75 and thence into the sheet receptacle 63. When the manual switch 69 is lowered to its dotted line position, the sheet deflector 61 is raised to its dotted line position causing sheets to advance from the roll pair 57, 59 into the receptacle 65. Sheets thus advancing into the receptacle 65 have their image side oriented upward while those advancing into the receptacle 63 have their image side oriented downward.

When the deflector 61 is oriented in its solid line position, sheets passing over the guide 71 are contacted by brush ends 77 which are also located in their solid line position. When the deflector 61 is located in its broken line position, sheets passing thereunder are contacted by brush ends 79 which are also located in their broken line position. As will be described, the brush ends 77 and 79 are fixedly secured to the deflector 61 and are grounded to thereby insure the electrostatic discharge of the sheets passing therepast.

Referring now to FIG. 2 of the drawing, a perspective view of the sheet deflector 61 and the grounded brush 81 is depicted. The grounded brush 81 includes a plurality of individual brushes 82 having brush ends 77 and brush ends 79. The brushes may consist of a bundle of electrically conductive fibers, such as, for example, carbon loaded nylon fibers or stainless steel fibers. It has been found that a minimum of three fiber bundles per inch of length adequately discharges sheets. It has also been found that a continuous filament brush having a pile density of 4,000 filaments or greater per linear inch also adequately discharges the sheets.

Each brush 82 is clamped between the deflector 61 and a grounded clamp 83. As described with respect to FIG. 1, when the deflector is oriented in its first position the sheets are routed past the brush ends 77. When the deflector 61 is oriented in its second position, sheets are routed past brush ends 79. Thus, brush wear is distributed over both ends of the brush. Further, the deflector 61 position selectively routes sheets over a first sheet feed path where the brush ends 77 contact the sheets or over a second sheet feed path where the brush ends 79 of the brush 81 contact the sheets. It has been found that under poor sheet feeding conditions, i.e., 60 degrees F., 8% relative humidity there is a 5 to 40 times reduction in static charge of plastic sheets fed into an output stack when using the brush 81 as compared to no brush.

Referring now to FIG. 3 of the drawing, an exploded perspective view of the transfer corona housing 87, paper guide 45 and grounded charge dissipation wire 47 is depicted. As described with respect to FIG. 1 of the drawing, sheets pass over the plastic guide 45 past the grounded wire 47. As can be seen from FIG. 3, the grounded wire 47 is located in proximity to the non-image bearing surface of the sheet as it moves thereover, but does not touch the sheet. The grounded wire 47 is connected to ground by hooking the coiled end around projection 85 of the grounded corona housing 87. The opposite end of the grounded wire 47 is hooked about the plastic tensioning arm 89 which forms a part of the plastic guide 45. The grounded wire is 0.002 inches in diameter and is made of gold plated tungsten. It is located 0.028 inches from the surface of the sheet as the sheet passes over the guide 45 and extends for the width of the sheet. It is also located approximately 0.35 inches from the point at which the sheet separates from the photoconductor drum 17.

The tightly tensioned grounded wire 47 is forced against a series of four tabs 91 located across the length of the guide 45 thereby precisely positioning the grounded wire 47 with respect to the surface of the guide 45. Since the guide is somewhat flexible, the biasing of the grounded wire 47 against the tabs 91 insures a precise gap between the sheet located on the guide 45 and the grounded wire. With reference to FIG. 4 of the drawing, it can be seen that the grounded wire 47 rides underneath the tab 91 and is located against wall 93 of the guide 45. By thusly locating the grounded wire 47 away from the wall 95, the surface 97 of the guide is able to retain the high voltage charge which is built up thereon. This charge corresponds with that on the sheet and thus there is not a discharge surface for the sheet to move over until it comes under the influence of the grounded wire 47.

By locating the grounded wire 47 in close proximity to the sheet, an intense electrical field is created between the statically charged sheet and the grounded wire 47. In typical dry conditions, a charge as high as 1500 volts may appear on the sheet. As the thusly charged sheet passes in proximity to the grounded wire, the air about the wire between it and the sheet becomes ionized thus providing a discharge of the static charge on the sheet to the wire and thence to ground. When sheets are fed in a moister, more humid situation, there is a much smaller charge built up on the sheet since the charge is dissipated due to the lateral conductivity within the sheet. Then, the smaller charge on the sheet does not cause extensive ionization of the air between the grounded wire 47 and the sheet. Thus, sheets are discharged only when they need to be without any requirement for extensive controls as was the case with prior art powered corona devices.

Referring once again to FIG. 1 of the drawing, in operation, sheets are fed to the photoconductor drum 17 which has a toner image located thereon. The powered transfer corona 43 sprays the backside of the sheet so that the sheet attracts the toner image thereupon. Upon separation from the photoconductor drum, the sheet moves in close proximity to the grounded wire 47 which serves as a charge neutralizer to eliminate most of the static charge of the sheet without disturbing the toner image thereon. The sheet then moves to a fuser roll 51 which heats the toner particles on the sheet causing them to melt into the sheet thus fixing the image thereto. The sheet then progresses to a deflector 61 which either routes the sheet over the guide 71 and past the grounded brush ends 77 or in the alternative, past the grounded brush ends 79 into the sheet receptacle 65. Grounded brush ends 79 and 77 serve to discharge the static charge remaining on the sheet prior to its entry into the sheet receptacle 63 and 65. Further, the brush ends 79 serve to provide a small drag force thus decelerating the sheet as it exits into the sheet receptacle 65.

While the invention has been particularly shown and described with reference to the preferred embodiment thereof, it will be understood by those skilled in the art that the foregoing and other changes in form and detail may be made therein without departing from the spirit and scope of the invention.

What is claimed is:

1. A printing machine for producing printed sheets comprising:

a sheet deflector for routing sheets along a first exit path when located in a first position and along a second exit path when located in a second position; and brush means having first and second brush ends mounted on said deflector and connected to ground, said first brush ends contacting the sheet when deflected along said first path and said second brush ends contacting the sheet when deflected along said second path to thereby discharge static charge on the sheet as the sheet passes over either said first and second paths.

2. The electrophotographic printing machine set forth in claim 1 wherein said second brush ends decelerate the sheet as it exits the printing machine.

3. An electrophotographic printing machine for producing printed sheets comprising:

a photoreceptor for receiving a latent image thereon in the form of a charge pattern;

developer means for developing a toned image corresponding to the charge pattern on the photoreceptor;

sheet feed means for feeding sheets to a transfer station;

transfer means located at the transfer station including a corona discharge means for effecting transfer of the toned image to the sheet by forming a charge on the non-image receiving side of the sheet; and means for neutralizing the charge on the sheet including (a) a wire, connected to ground and located in proximity to but not touching the sheet, closely following the transfer station in the sheet feed direction, (b) a grounded projection to which a first end of the wire is secured, and (c) a tensioning arm to which the second end of the wire is secured.

4. An electrophotographic printing machine for producing printed sheets comprising:

a photoreceptor for receiving a latent image thereon in the form of a charge pattern;

developer means for developing a toned image corresponding to the charge pattern on the photoreceptor;

sheet feed means for feeding sheets to a transfer station;

transfer means located at the transfer station including a corona discharge means for effecting transfer of the toned image to the sheet by forming a charge on the non-image receiving side of the sheet; and means for neutralizing the charge on the sheet including;

(a) a wire connected to ground and located in proximity to but not touching the sheet following the transfer station in the sheet feed direction;

(b) a deflector for routing a sheet to a first exit path when located in a first position and to a second exit path when located in a second position; and (c) brush means having first and second brush ends mounted on said deflector and connected to ground, said first brush ends contacting the sheet when deflected along said first path and said second brush ends contacting the sheet when deflected along said second path.

5. The electrophotographic printing machine set forth in claim 4 wherein said second brush ends decelerate the sheet as it exits the printing machine.

6. The electrophotographic printing machine set forth in claim 4 wherein the deflector routes the sheet in a first orientation to the first exit path when located in the first position and in a second orientation to a second exit path when located in the second position.

* * * * *